US009700489B2

(12) United States Patent
Kenowski et al.

(10) Patent No.: US 9,700,489 B2
(45) Date of Patent: Jul. 11, 2017

(54) FEEDING TUBE TIP REINFORCEMENT

(75) Inventors: Michael A. Kenowski, Alpharetta, GA (US); Katherine L. Dziak, Cumming, GA (US); Donald J. McMichael, Roswell, GA (US); John A. Rotella, Roswell, GA (US)

(73) Assignee: Avent, Inc., Alpharetta, GA (US)

( * ) Notice: Subject to any disclaimer, the term of this patent is extended or adjusted under 35 U.S.C. 154(b) by 1036 days.

(21) Appl. No.: 13/548,823

(22) Filed: Jul. 13, 2012

(65) Prior Publication Data

US 2014/0018741 A1 Jan. 16, 2014

(51) Int. Cl.
*A61J 15/00* (2006.01)

(52) U.S. Cl.
CPC ..... *A61J 15/0015* (2013.01); *A61J 15/0042* (2013.01); *A61J 15/0057* (2013.01); *A61J 15/0073* (2013.01); *F04C 2270/041* (2013.01)

(58) Field of Classification Search
CPC ..... A61J 15/0015; A61J 15/0019; A61J 15/0023; A61J 15/003; A61J 15/0034; A61J 15/0042; A61J 15/0026; A61J 15/0038; A61J 15/0046; A61J 15/0049; A61J 15/0057; A61J 15/0061; A61J 15/0065; A61J 15/0069; A61J 15/0073; A61M 25/0071; A61M 25/10
See application file for complete search history.

(56) References Cited

U.S. PATENT DOCUMENTS 2,457,244 A * 12/1948 Lamson ..... A61F 2/0013 600/29
2,687,131 A * 8/1954 Raiche ..... A61F 5/4553 604/101.05
3,896,816 A * 7/1975 Mattler ..... A61M 25/1009 604/103.03
4,601,713 A * 7/1986 Fuqua ..... A61M 25/0023 604/103.14
4,752,286 A * 6/1988 Okada ..... A61B 17/12 604/104

(Continued)

FOREIGN PATENT DOCUMENTS

EP 0 853 937 A1 7/1998
WO WO 03/039383 * 3/2003
WO WO 03/039383 A1 5/2003

*Primary Examiner* — Imani Hayman
*Assistant Examiner* — Laura Schell
(74) *Attorney, Agent, or Firm* — Dority & Manning, P.A.

(57) ABSTRACT

A feeding tube assembly having an improved feeding tube body composed of a tube wall having an external tube surface and an internal tube surface, a proximal end, a distal end separated from the proximal end by a length, and a distal tip region. The internal tube surface defines a feeding passageway extending the proximal end to the distal tip region. The tube body has a first cross-sectional profile from the proximal end to the distal end and at least a second cross-sectional profile from the distal end to the distal tip region. In the first cross-sectional profile, the external tube surface defines an external circumference and the internal tube surface defines a generally non-circular internal perimeter dividing the tube wall into one thin-walled portions and thick-walled portions. In the second cross-section profile, the external tube surface defines an external circumference and the internal tube surface defines an internal circumference.

11 Claims, 3 Drawing Sheets

(56) References Cited

U.S. PATENT DOCUMENTS

| | | | | | |
|---|---|---|---|---|---|
| 4,754,752 | A * | 7/1988 | Ginsburg | A61B 18/08 | 604/113 |
| 4,921,483 | A * | 5/1990 | Wijay | A61M 25/1002 | 604/102.02 |
| 4,927,412 | A * | 5/1990 | Menasche | A61M 25/1002 | 604/103.08 |
| 5,997,503 | A * | 12/1999 | Willis | A61J 15/0015 | 604/103.07 |
| 2004/0147874 | A1* | 7/2004 | Kliem | A61J 15/0042 | 604/96.01 |
| 2011/0152762 | A1* | 6/2011 | Hershey et al. | 604/99.02 | |

* cited by examiner

FEEDING TUBE TIP REINFORCEMENT

FIELD OF THE INVENTION

The present invention relates to an improved tube structure for an indwelling catheter or tube. More particularly, the present invention relates to an improved tube structure for gastrostomy tubes or enteral feeding catheters having a base deployed outside the human body and a retainer for deployment within a lumen of the body.

BACKGROUND OF THE INVENTION

Feeding tubes are generally conventional flexible plastic tubes having a lumen formed therethrough. In some cases, these tubes have additional small lumens formed in the tube to allow for inflation of a retention balloon.

Conventional feeding tubes are formed of silicone and have thick walls that can restrict the flow of feeding solution through the tubes. This is particularly noticeable when the feeding tubes are configured so that additional lumens are formed in the tube walls. Attempts to change the shape and location of the lumens of these feeding tubes provide areas of weakness in the tube walls that dispose the tubes to kinking, bending or back-folding during insertion which can make it difficult to initially place the tube. This problem can be particularly apparent at the tip of the feeding tube.

There is a need for a feeding tube assembly that can provide a relatively large flow without increasing the overall diameter or circumference of the tube. There is also a need for a feeding tube that has relatively thin walls but is not disposed to kinking, bending or back-folding during insertion. There is also a need for a feeding tube having a tip which allows for ease of insertion.

BRIEF SUMMARY OF THE INVENTION

The problems described above are addressed by the present invention which encompasses a feeding tube assembly having an improved feeding tube body. The feeding tube assembly includes a feeding tube body with a tube wall having an external tube surface and an internal tube surface. The tube body has a proximal end, a distal end separated from the proximal end by a length, and a distal tip region. The internal tube surface defines a feeding passageway extending from an opening at the proximal end of the tube body to an opening at the distal tip region.

The feeding tube assembly also includes a base located at the proximal end of the feeding tube body, the base being deployed outside a human body and defining an opening to the feeding passageway, the base having a first end and a second end. The assembly also includes a retention member located at a distal end of the feeding tube body, the retention member being deployed in a lumen of a human body.

According to an aspect of the invention, the feeding tube body has a first cross-sectional profile from its proximal end to its distal end. The first cross-sectional profile is characterized by the external tube surface defining an external circumference and by the internal tube surface defining a generally non-circular internal perimeter. The feeding tube body also has at least a second cross-sectional profile from its distal end to its distal tip region. The second cross-section profile is characterized by the external tube surface defining an external circumference and by the internal tube surface defining an internal circumference.

The first cross-sectional profile divides the tube wall into at least one thin-walled portion and at least one thick-walled portion to define a generally oblong cross-section. The second cross-sectional profile provides a generally uniform tube wall. That is, the second cross sectional profile does not have wall thickness differences that generate a non-circular cross-section.

In an aspect of the invention, the tube wall defines at least one additional lumen. The additional lumen extends from an opening at the proximal end through the tube body and terminates at an opening at the exterior surface at the distal end and proximal to the distal tip region. Desirably, the at least one additional lumen is located in a thick-walled portion of the tube wall.

In another aspect of the invention, the distal tip region has a first portion and a second portion, the first portion being proximal to the second portion and in which the first portion has a greater wall thickness than the second portion. Desirably, both the first and second portions have substantially the same external circumference.

The feeding tube body is desirably formed of a thermoplastic polymer. More desirably, the feeding tube body is formed of thermoplastic polyurethane having a Shore Hardness of from about 65A to about 80A.

Other objects, advantages and applications of the present disclosure will be made clear by the following detailed description of a preferred embodiment of the disclosure and the accompanying drawings wherein reference numerals refer to like or equivalent structures.

DETAILED DESCRIPTION

Figure 1B:
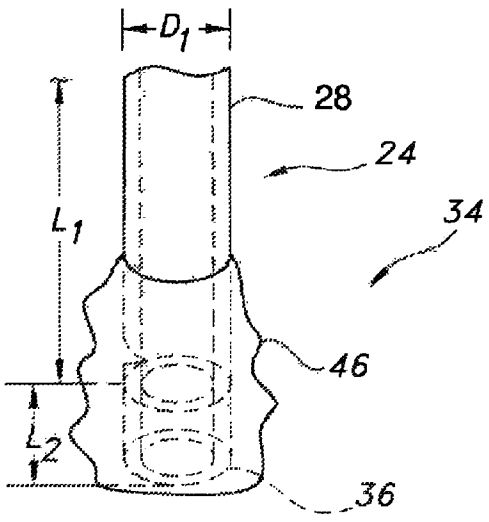
FIG. 1B is a perspective view illustration of a detail of an exemplary feeding tube assembly.

Reference will now be made in detail to one or more embodiments, examples of which are illustrated in the drawings, such drawings are not necessarily to scale. It should be understood that features illustrated or described as part of one embodiment may be used with another embodiment to yield still a further embodiment.

Figure 1A:
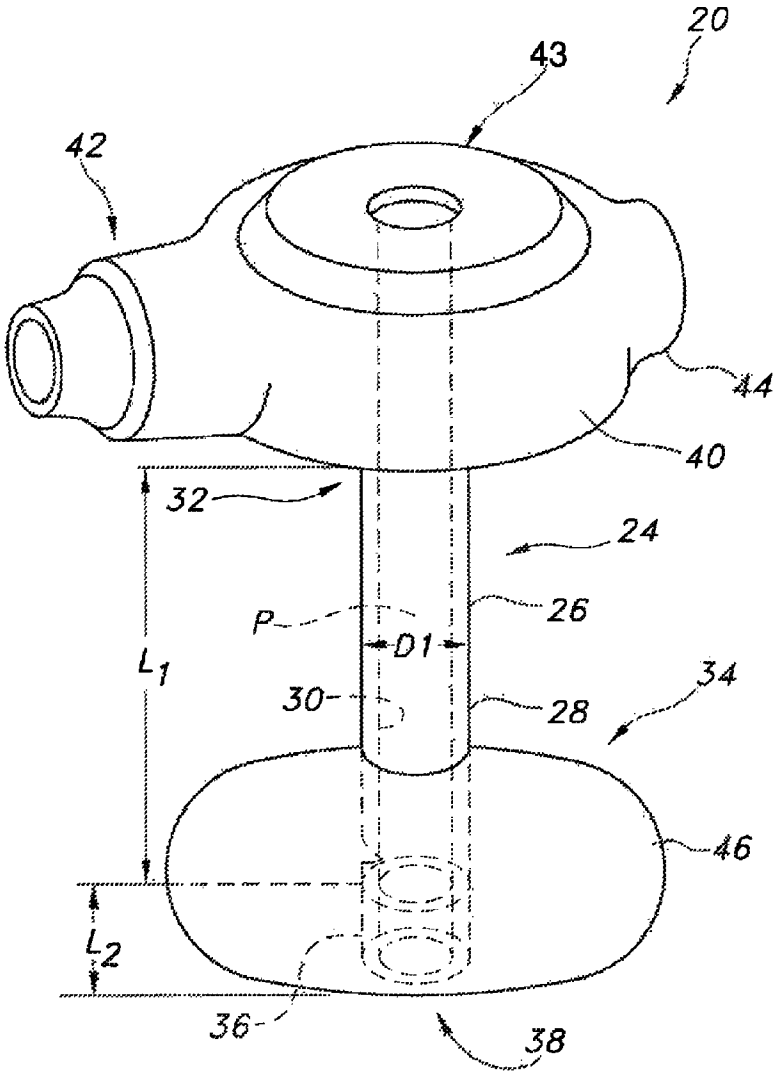
FIG. 1A is a perspective view illustration of an exemplary feeding tube assembly having an improved feeding tube body with a reinforced feeding tube tip.

Turning now to the drawings, there is shown at FIG. 1A a perspective view illustrating an exemplary feeding tube assembly 20 having an improved feeding tube body 24.

The feeding tube assembly includes a feeding tube body 24 with a tube wall 26 having an external tube surface 28 and an internal tube surface 30. The tube body 24 has a proximal end 32, a distal end 34 separated from the proximal end by a length "L1", and a distal tip region 36 having a length "L2". The tube body 24 may have an external tube diameter "D1". The internal tube surface 30 defines a continuous feeding passageway "P" extending from an opening at the proximal end 32 of the tube body 24 to a single opening 38 at the distal tip region 36.

The feeding tube assembly also includes a base 40 located at the proximal end 32 of the feeding tube body 24, the base 40 being deployed outside a human body and defining an opening 43 to the feeding passageway "P", the base 40 having a first end 42 and a second end 44. The assembly 24 also includes a retention member 46 located at a distal end 34 and including or encompassing the distal tip region 36 of the feeding tube body 24, the retention member 46 (e.g., an inflatable balloon) being deployed in a lumen of a human body. In FIG. 1A, the retention member 46 is shown in an inflated state.

FIG. 1B is a perspective view illustrating a detail of the feeding tube body 24 showing its distal end 34 and the distal tip region 36, including a retention member 46 (e.g., an inflatable balloon). In this illustration, the retention member 46 is shown in a deflated state.

Figure 2A:
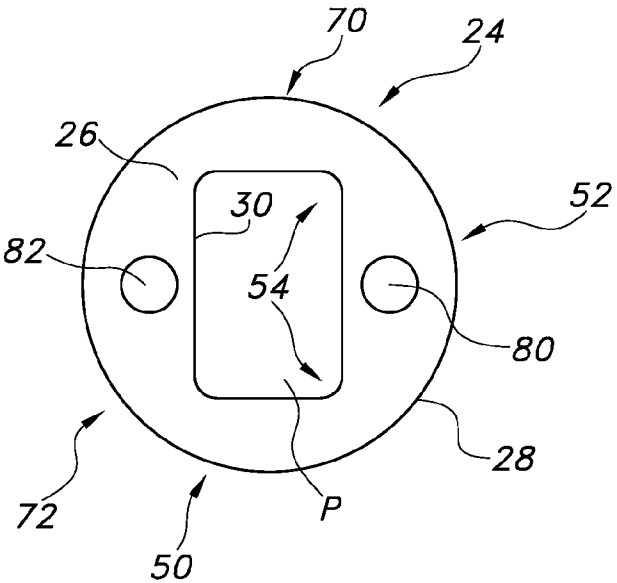
FIG. 2A is a cross-sectional view illustrating a detail of an exemplary radial cross-section at a location on a first length of an exemplary feeding tube body.
Figure 2B:
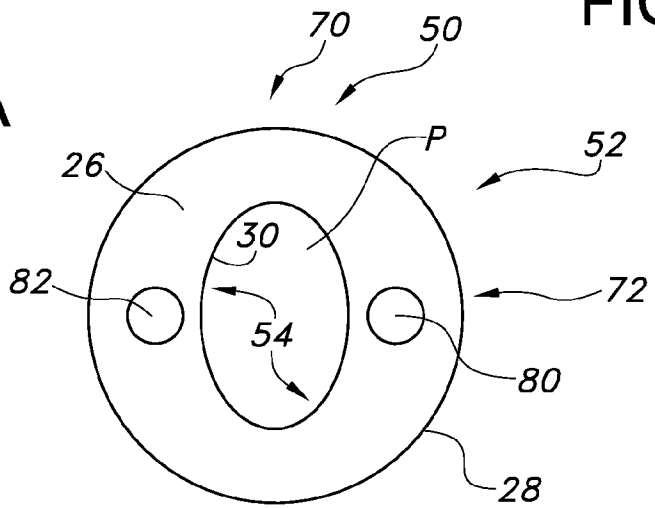
FIG. 2B is a cross-sectional view illustrating a detail of an exemplary radial cross-section at a location on a first length of another exemplary feeding tube body.

Referring now to FIG. 2A of the drawings there is shown a radial cross sectional view of the feeding tube body 24 at a point along length "L1" from its proximal end 32 to its distal end 34 illustrating a first cross-sectional profile 50. The first cross-sectional profile 50 is characterized by the external tube surface 28 defining an external circumference 52 and by the internal tube surface 30 defining a generally non-circular internal perimeter 54. Exemplary alternative cross-sectional profiles are contemplated. As a non-limiting example, FIG. 2B illustrates a radial cross sectional view showing an exemplary first cross-sectional profile 50 of a different exemplary feeding tube body 24 at a point along length "L1" from its proximal end 32 to its distal end 34 in which the external tube surface 28 defines an external circumference 52 and the internal tube surface 30 defines a generally non-circular internal perimeter 54.

Figure 3:
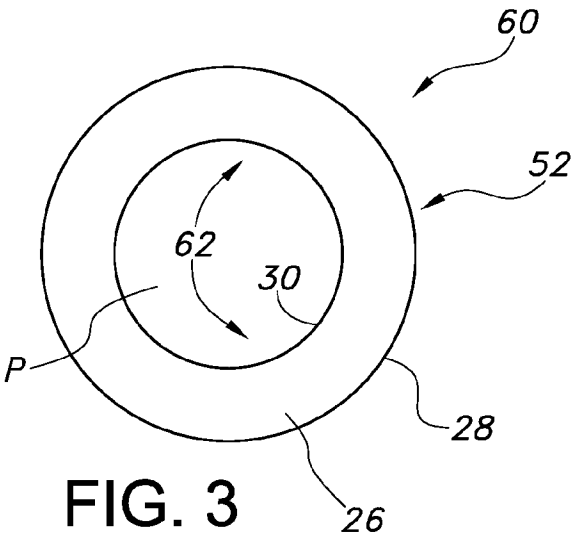
FIG. 3 is a cross-sectional view illustrating a detail of an exemplary radial cross-section at a location on a second length of an exemplary distal tip region of a feeding tube body.

Referring now to FIG. 3 of the drawings, there is shown a radial cross sectional view of the feeding tube body 24 along length "L2" from its distal end 34 to its distal tip region 36 illustrating at least a second cross-sectional profile 60. The second cross-section profile 60 is characterized by the external tube surface 28 defining an external circumference 52 and by the internal tube surface 30 defining an internal circumference 62.

Referring again to FIGS. 2A and 2B, the first cross-sectional profile 50 divides the tube wall 26 into diametrically opposed thin-walled portions 70 and diametrically opposed thick-walled portions 72 along length "L1" to define a generally oblong or oval internal cross-section profile for the feeding passageway "P". In contrast, the second cross-sectional profile 60 provides a tube wall 26 of generally uniform thickness along length L2. That is, the second cross sectional profile 60 does not have wall thickness differences that generate a non-circular cross-section.

In an aspect of the invention, the tube wall 26 defines one or more additional lumens 80 and 82. The additional lumen (s) 80, 82 extend from an opening at the proximal end through the tube body 24 along length "L1" and terminate at an opening at the external surface 28 at the distal end 34 and proximal to the distal tip region 36. That is, the at least one or more additional lumen 80 is not present along length "L2" in the distal tip region 36. Desirably, the at least one or more additional lumen 80 (e.g., optionally 82, etc.) is located in a thick-walled portion 72 of the tube wall 26. The one or more additional lumen(s) may be an inflation lumen or an indicator lumen or it may have other functions. For example, if the retention member 46 is an inflatable balloon, the retention member 46 is desirably in fluid communication with the additional lumen 80 and 82. In this regard, lumen 80 may be an inflation lumen and lumen 82 may be a lumen that is in fluid communication with an indicator.

Figure 4:
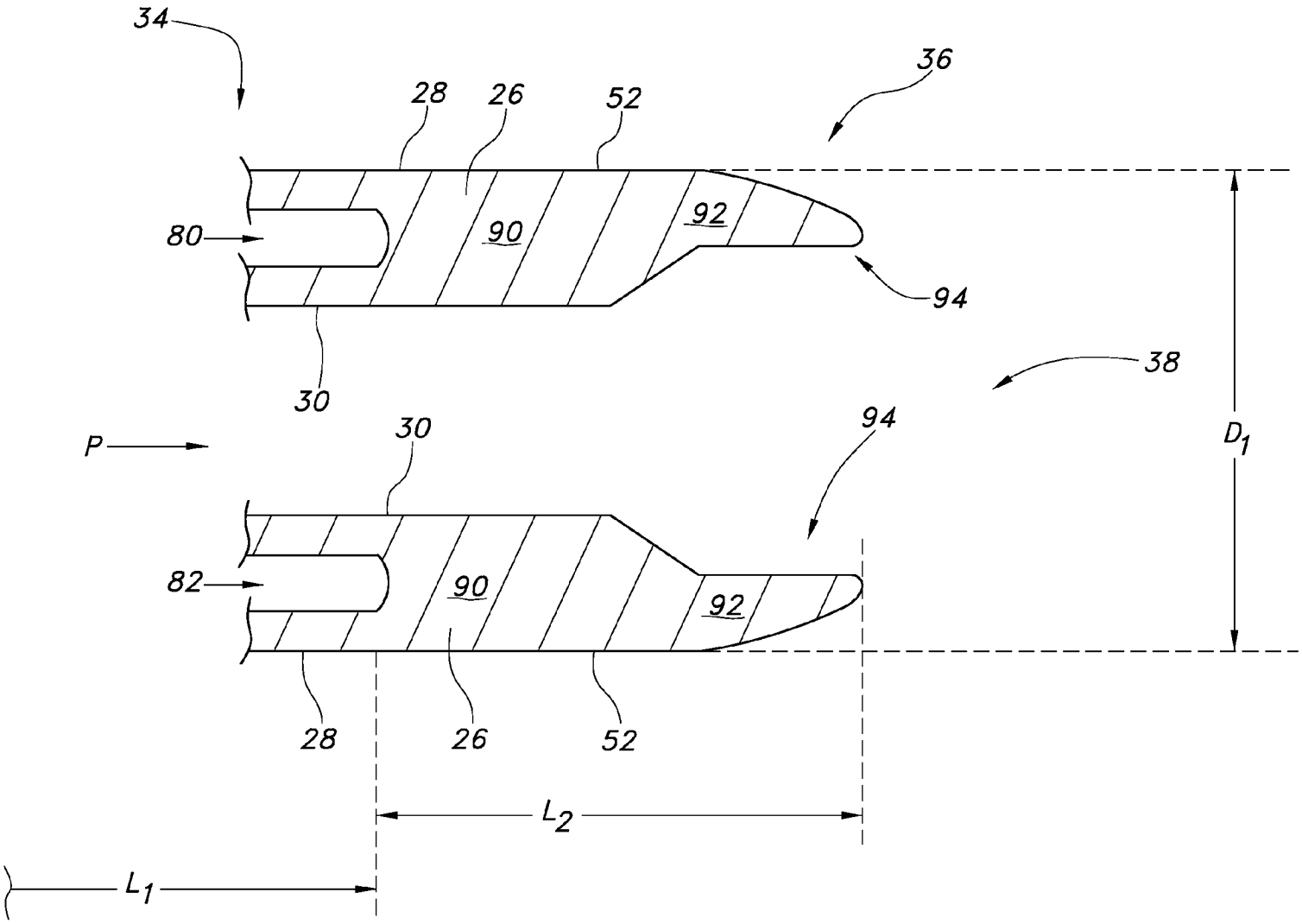
FIG. 4 is a cross-sectional view illustrating a detail of an exemplary longitudinal cross-section along a second length of an exemplary distal tip region of a feeding tube body.

Referring now to FIG. 4 of the drawings, there is show a side or longitudinal cross-sectional view of an exemplary distal tip region 36 from FIGS. 1A and 1B. That is, the cross-sectional view is along the longitudinal axis of the tube body 24 extending from the base 40 and proximal end 32 to the distal end 34 and distal tip region 36. In other words, the longitudinal cross section illustrated in FIG. 4 is perpendicular to the radial cross-sectional views illustrated in FIGS. 2A, 2B and 3.

The distal tip region 36 has a first portion 90 and a second portion 92, the first portion 90 being proximal to the second portion 92 and in which the first portion 90 has a greater tube wall 26 thickness than the second portion 92. Desirably, both the first and second portions 90, 92 have substantially the same external circumference 52.

The greater wall tube thickness in the first portion 90 provides reinforcement that is absent from the tube body 24 proximal to the distal tip region 36 because the additional lumens are absent and the void space is filled in with tube material. In addition, the second portion of the distal tip region 92 is thinner relative to the first portion. Desirably, the end 94 of the second portion 92 of the distal tip region 36 has a slight taper.

The feeding tube body 24 is desirably formed of a thermoplastic polymer. More desirably, the feeding tube body is formed of thermoplastic polyurethane having a Shore Hardness of from about 65A to about 80A.

The tube is desirably formed of a material that is generally harder, tougher and/or less elastic than conventional silicone tubing used for enteral feeding tubes. As an example, the tube may be formed of a material having a Shore Hardness of from about 65A to about 80A and an ultimate tensile of between about 2500 to about 6000 pounds$_f$ per square inch (psi). While such a material may have a tensile force of 300 psi at an elongation about 100 percent and/or a tensile force of 500 psi at an elongation about 200 percent (which may be similar to some conventional silicone elastomeric materials) the greater hardness and ultimate tensile is thought to make the tube more resistant to stretching while still retaining flexibility. Exemplary materials include thermoplastic polyurethanes such as TECOFLEX® medical-grade aliphatic polyether polyurethanes available from Lubrizol Advanced Materials, Inc., Thermedics™ Polymer Products, Wilmington, Mass. For example, TECOFLEX® EG-80A has been found to work particularly well. Table 1 below provides some representative properties for TECOFLEX® EG-80A.

TABLE 1

| | ASTM Test | TECOFLEX ® EG-80A |
|---|---|---|
| Durometer (Shore Hardness) | D2240 | 72A |
| Specific Gravity | D792 | 1.04 |
| Flexural Modulus (psi) | D790 | 1,000 |
| Ultimate Tensile (psi) | D412 | 5,800 |
| Ultimate Elongation (%) | D412 | 660 |
| Tensile (psi) at 100% Elongation | D412 | 300 |
| Tensile (psi) at 200% Elongation | D412 | 500 |
| Tensile (psi) at 300% Elongation | D412 | 800 |

As noted above, the material of the tube may desirably have a Shore Hardness of from about 65A to about 80A. The Shore Hardness testing of plastics is most commonly measured by the Shore (Durometer) test using either the Shore A or Shore D scale. The Shore A scale is used for "softer"

rubbers while the Shore D scale is used for "harder" ones. The Shore A Hardness is the relative hardness of elastic materials such as rubber or soft plastics can be determined with an instrument called a Shore A Durometer. If the indenter completely penetrates the sample, a reading of 0 is obtained, and if no penetration occurs, a reading of 100 results. The reading is dimensionless.

The Shore hardness is measured with an apparatus known as a Durometer and is sometimes also referred to as Durometer Hardness. The hardness value is determined by the penetration of the Durometer indenter foot into the sample. Because of the resilience of rubbers and plastics, the hardness reading may change over time so the indentation time is sometimes reported along with the hardness number. The ASTM test number is ASTM D2240 while the analogous ISO test method is ISO 868.

According to the present invention, it has been found that using the harder, tougher materials allows for a feeding tube body 24 having relatively thinner tube walls 26 than conventional silicone materials. This allows the tube to provide a larger feeding passageway "P" for a given diameter. Moreover, the inclusion of one or more lumen 80, 82 such as an inflation lumen and an indicator lumen in addition to the feeding passageway "P" can be accommodated because the tube wall 26 can be made thinner. It is believed that having thin-walled portions 70 and thick-walled portions 72 extending longitudinally in a feeding tube body 24 may cause the tube wall 26 to initiate folding, bending, or buckling in the thin-walled portions 70, particularly if a force is applied inwardly against the thin-walled portion 70 near the distal end during insertion.

According to the present invention, it is believed that providing a distal tip region 36 of the tube body 24 having a generally uniform and relatively greater wall thickness along the circumference or the radial cross section of the first portion 90 helps reinforce the tube wall against folding, bending, or buckling—at least in that reinforced region. It is thought that during difficult insertion through fascia (e.g., fascial layers of the abdomen), folding, bending, or buckling is most likely to occur or propagate at the contact with the fascia so that reinforcing the distal tip region 36 by making its first portion 90 thicker and by making the radial cross section generally uniform, the forces encountered during insertion are more likely to be dissipated and transmitted longitudinally along the tube body helping to avoid folding, bending, or buckling.

In addition, the generally uniform and relatively lower wall thickness along the circumference or the radial cross section of the second portion 92 of the distal tip region 36 helps provide flexibility that can reduce tissue trauma during insertion.

Referring to FIG. 4 of the drawings, the tube body 24 may have an external tube diameter "D1" that may range from about 3 mm to about 9 mm depending on the size of the feeding tube, the stoma size and details of the patient. The length "L2" may range from about 0.2 inch to about 0.5 inch (about 5 mm to about 13 mm). The length "L1" may range from about 0.7 inch to about 3 inches (about 18 mm to about 77 mm).

While various patents have been incorporated herein by reference, to the extent there is any inconsistency between incorporated material and that of the written specification, the written specification shall control. In addition, while the disclosure has been described in detail with respect to specific embodiments thereof, it will be apparent to those skilled in the art that various alterations, modifications and other changes may be made to the disclosure without departing from the spirit and scope of the present disclosure. It is therefore intended that the claims cover all such modifications, alterations and other changes encompassed by the appended claims.

What is claimed is:

1. A feeding tube assembly, the assembly comprising:

a feeding tube body including a tube wall having an external tube surface and an internal tube surface, a proximal end, a distal-most end separated from the proximal end by a length, and a distal tip region extending proximal from the distal-most end, the internal tube surface defining a continuous feeding passageway extending from an opening at the proximal end of the tube body to a single opening at the distal-most end region, the internal tube surface being continuous from the opening at the proximal end of the tube to the single opening the feeding tube body having:

a first cross-sectional profile that is taken at any point between the proximal end and a point proximal to the distal tip region and wherein the first cross-sectional profile is perpendicular to a longitudinal axis of the tube assembly, the first cross-sectional profile characterized by the external tube surface defining an external circumference and by the internal tube surface defining a non-circular internal perimeter having a symmetrically elongated profile which defines thick-walled portions diametrically opposite to each other and thin-walled portions diametrically opposite to each other;

the feeding tube body having a second cross-sectional profile that is taken at any point along the distal tip region, and wherein the second cross-sectional profile is perpendicular to the longitudinal axis of the tube assembly, the second cross-sectional profile is characterized by the external tube surface defining an external circumference and by the internal tube surface defining an internal circumference;

the feeding tube body having a third cross-sectional profile taken along the distal tip region, the third cross-sectional profile being taken along longitudinal axis of the tube assembly, wherein the third cross-sectional profile has a wall thickness that varies along the length of the distal tip region, wherein a first portion of the wall thickness is greater in thickness than a second portion of the wall thickness, wherein the second portion is distal to the first portion, and wherein the feeding passageway along the second portion has a greater diameter than the feeding passageway along first portion, and wherein the greater diameter of the second portion extends to the distal-most end of the feeding tube;

a base located at the proximal end of the feeding tube body, the base configured to be deployed outside a human body and defining an opening to the feeding passageway, the base having a first end and a second end; and a retention member located at the distal tip region of the feeding tube body, the retention member configured to be deployed in a lumen of the human body.

2. The assembly of claim 1, wherein the non-circular internal perimeter has a generally rectangular cross-section.

3. The assembly of claim 2, wherein the tube wall defines at least one additional lumen, the additional lumen extending from an opening at the proximal end through the tube body such that it is present within the first cross-sectional profile.

4. The assembly of claim 3, wherein the at least one additional lumen is located in one of the thick-walled portions of the tube wall.

5. The assembly of claim 1, wherein both the first and second portions have substantially a same external circumference along a portion of the third cross-sectional profile.

6. The assembly of claim 1, wherein the feeding tube body is formed of a thermoplastic polymer.

7. The assembly of claim 6, wherein the thermoplastic polymer is polyurethane having a Shore Hardness of from about 65A to about 80A.

8. A feeding tube assembly, the assembly comprising:

a feeding tube body including a tube wall having an external tube surface and an internal tube surface, a proximal end, a distal-most end separated from the proximal end by a length, and a distal tip region extending proximal from the distal-most end, the internal tube surface defining a continuous feeding passageway extending from an opening at the proximal end through the tube body to a single opening at the distal-most end, the internal tube surface being continuous from the opening at the proximal end of the tube to the single opening at the distal-most end, the feeding tube body having:

a first cross-sectional profile that is taken at any point between the proximal end and a point proximal to the distal tip region, and wherein the first cross-sectional profile is perpendicular to a longitudinal axis of the tube assembly, the first cross-sectional profile characterized by the external tube surface defining an external circumference and by the internal tube surface defining a non-circular internal perimeter, the first cross-sectional profile dividing the tube wall into diametrically opposite thin-walled portions and diametrically opposite thick-walled portions;

a second cross-sectional profile that is taken at any point along the distal tip region, and wherein the second cross-sectional profile is perpendicular to the longitudinal axis of the tube assembly, the second cross-sectional profile is characterized by the external tube surface defining an external circumference and by the internal tube surface defining an internal circumference;

at least one additional lumen, the additional lumen extending from an opening at the proximal end through the tube body, the at least one additional lumen being located in a thick-walled portion of the tube wall, and a third cross-sectional profile taken along the distal tip region, the third cross-sectional profile being taken along the longitudinal axis of the tube assembly, the third cross-sectional profile comprising a first portion and a second portion, the first portion being proximal to the second portion and in which the first portion has a wall thickness and the second portion has a wall thickness that is less than the first wall thickness, wherein the feeding passageway along the second portion has a greater diameter than the feeding passageway along the first portion, and wherein the greater diameter of the second portion extends to the distal-most end of the feeding tube body;

a base located at the proximal end of the feeding tube body, the base configured to be deployed outside a human body and defining an opening to the feeding passageway, the base having a first end and a second end; and a retention member located at a distal end of the feeding tube body, the retention member configured to be deployed in a lumen of a human body.

9. The assembly of claim 8, wherein the third cross-sectional profile comprises a tube wall thickness that varies along a length thereof.

10. The assembly of claim 8, wherein the feeding tube body is formed of a thermoplastic polymer.

11. The assembly of claim 10, wherein the thermoplastic polymer is thermoplastic polyurethane having a Shore Hardness of from about 65A to about 80A.

* * * * *